US005757134A

United States Patent [19]

Williamson

[11] Patent Number: 5,757,134

[45] Date of Patent: May 26, 1998

[54] MICA HEAT SHIELD FOR HIGH INTENSITY DISCHARGE LAMP

[75] Inventor: Glen P. Williamson, Manchester, N.H.

[73] Assignee: Osram Sylvania Inc., Danvers, Mass.

[21] Appl. No.: 738,375

[22] Filed: Oct. 25, 1996

[51] Int. Cl.[6] ..... H01J 17/02

[52] U.S. Cl. ..... 313/613; 313/42; 313/623; 313/626

[58] Field of Search ..... 313/25, 42, 43, 313/613, 626, 292, 275, 623, 332, 333, 334, 335, 239

[56] References Cited

U.S. PATENT DOCUMENTS

| | | | |
|---|---|---|---|
| 1,930,090 | 10/1933 | Gaidies | 313/626 |
| 4,910,427 | 3/1990 | Aelterman et al. | 313/25 |
| 5,466,987 | 11/1995 | Williamson | 313/25 |

*Primary Examiner*—George M. Dombroske
*Assistant Examiner*—Harshad Patel
*Attorney, Agent, or Firm*—William H. McNeill

[57] ABSTRACT

A high intensity discharge lamp has a light transmissive envelope and an arc tube located within the envelope. The arc tube contains an arc generating and sustaining medium as well as electrodes. A flare is sealed to the lamp envelope and the flare includes two electrically conductive lead-ins sealed therein, each of the lead-ins having a given diameter. A mica heat shield comprising a planar mica disc frictionally engages the lead-ins, the mica disc having a pair of lead-in receiving apertures therein, the receiving apertures having a diameter greater than the given diameter and each having an oppositely extending, radial slot extending therefrom, each of the slots having a width less than the given diameter. The mica heat shield is positioned on the lead-ins closely and adjacent to the upper surface of the flare by having the slots in frictional engagement with the lead-ins.

3 Claims, 2 Drawing Sheets

MICA HEAT SHIELD FOR HIGH INTENSITY DISCHARGE LAMP

TECHNICAL FIELD

This invention relates to high intensity discharge lamps and more particularly to heat shields therefor.

BACKGROUND ART

Prior heat shields of the metal variety required expensive insulator sleeves to isolate the shield from the lead-ins and usually required welding or some other means of affixation to achieve a proper position. Prior insulating shields such as mica discs, were difficult to position, usually demanding that a sleeve be placed over the in-lead after the mica was assembled. This sleeve would then be crimped or welded to the in-lead to maintain the position of the mica. Such processes contributed non-value added parts to each mount assembly which increased the cost of the mount and thus the ultimate lamp.

DISCLOSURE OF INVENTION

It is, therefore, an object of the invention to obviate the disadvantages of the prior art.

It is another object of the invention to enhance the assembly of lamp mounts.

These objects are accomplished, in one aspect of the invention, by a mica heat shield for a high intensity discharge lamp which comprises a planar mica disc for frictionally engaging a pair of lamp lead-ins. The lamp lead-ins have a given diameter, and the mica disc has a pair of lead-in receiving apertures therein. The receiving apertures have a diameter greater than the given diameter and they each have an oppositely extending, radial slot extending therefrom. Each of the slots has a width less than the given diameter. A method of making a mount for a high intensity discharge lamp comprises the steps of forming a glass flare having two electrically conductive, spaced-apart lead-ins, each having a given diameter, projecting therefrom. A mica heat shield for protecting the flare and base is formed and comprises a planar mica disc having a pair of lead-in receiving apertures therein, these apertures having a diameter greater than the given diameter and each having an oppositely extending radial slot extending therefrom. The slots have a width less than the given diameter. The lead-ins are fitted thru the lead-in receiving apertures until the mica reaches a position adjacent a surface of the flare, whereupon the mica is rotated so that the oppositely extending slots frictionally engage the lead-ins and firmly position the mica. Subsequently a discharge tube is attached to the lead-ins to form the mount.

The mica shield is thereby self-supporting and is suitable for automated assembly operations. Further, it eliminates the need for any additional mounting means, thereby reducing costs.

BEST MODE FOR CARRYING OUT THE INVENTION

Figure 1:
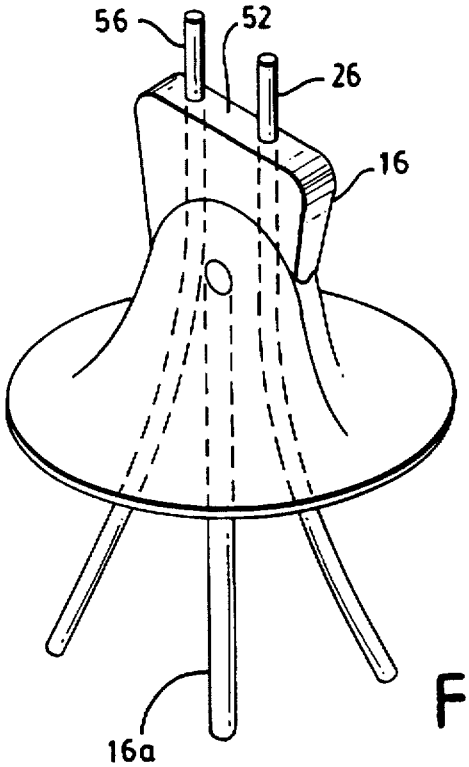
FIG. 1 is a perspective view of a flare for a high intensity discharge lamp.
Figure 3:
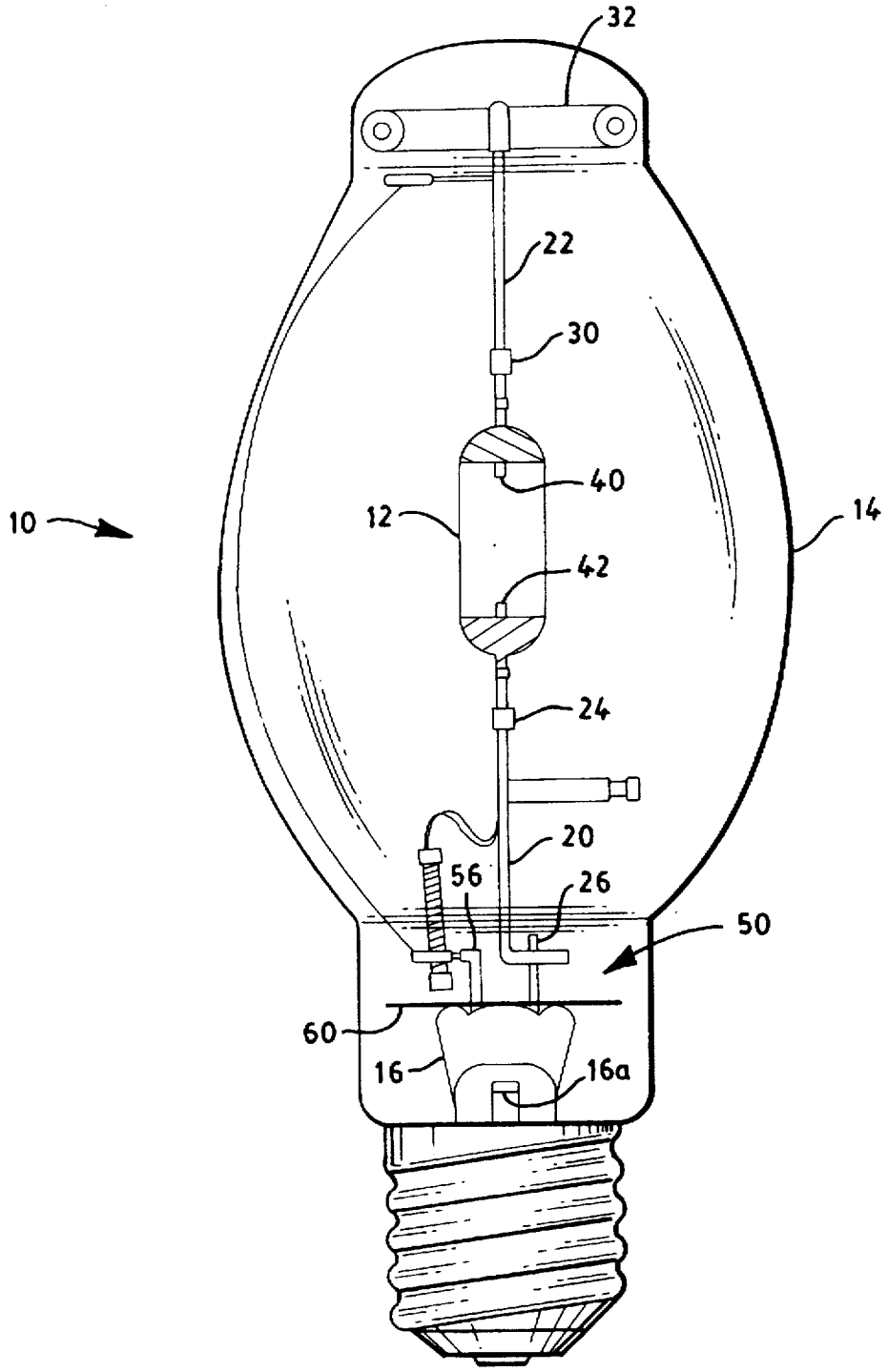
FIG. 3 is an elevational view of a high intensity discharge lamp with the mica shield in place.

For a better understanding of the present invention, together with other and further objects, advantages and capabilities thereof, reference is made to the following disclosure and appended claims taken in conjunction with the above-described drawings. Referring now to the drawings with greater particularity, there is shown in FIG. 3 a high intensity discharge lamp 10, which can be of the metal halide type, and which includes an arc tube 12, typically quartz, which is mounted within a light transmissive lamp envelope 14. The lamp envelope is hermetically sealed to a flare 16 (see FIG. 1) which has lead-ins 26 and 56, each of which have a given diameter, sealed therein. The lamp envelope can be filled with an inert gas such as nitrogen at pressure of about 400 torr. Air can be exhausted and nitrogen admitted via exhaust tubulation **16*a* which is subsequently sealed. The arc tube is supported within the envelope 14 by a lower frame member 20 and an upper frame member 22. The lower frame member 20 is welded to a strap 24 that encircles a lower press seal of arc tube 12. The lower frame member 20 is attached at its other end to one of the lead-ins, for example 26. The upper frame member 22 is welded to a strap 30 that encircles an upper press seal of arc tube 12. Bulb spacers 32 attached to upper frame 22 contact an inside surface of the lamp envelope in the dome end thereof. The arc tube 12 contains electrodes 40 and 42 which are connected to the lead-ins 26 and 56** as is known in the art. U.S. Pat. No. 5,466,987, assigned to the assignee of the present invention and which is incorporated herein by reference, discloses a complete electrical hook-up.

Figure 2:
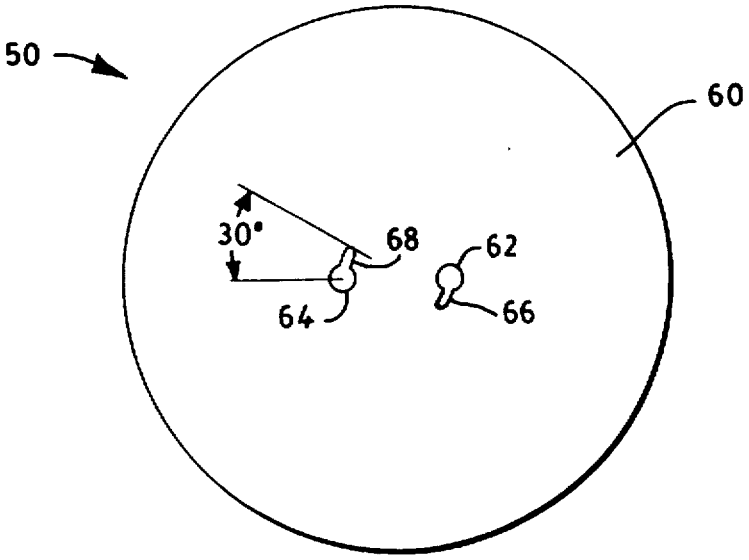
FIG. 2 is a plan view of a mica shield of the invention.

A mica heat shield 50 is positioned on the lead-ins 56 and 26 adjacent an upper surface 52 of flare 16. The mica heat shield 50 is shown in FIG. 2 and comprises a planar mica disc 60 for frictionally engaging the lamp lead-ins 56 and 26. The lamp lead-ins have a given diameter, typically 0.063 inches (1.60 mm), and the mica disc 60 has a pair of lead-in receiving apertures 62 and 64. The receiving apertures 62 and 64 have a diameter greater than the diameter of the lead-ins, typically in the order of 2.54 mm and each receiving aperture has an oppositely extending, radial slot 66 and 68 respectively, extending therefrom, each of the slots having a width less than the diameter of the lead-ins, typically 1.194 mm. The length of the slots 66 and 68, as measured from the center of the receiving apertures to the center of the radius marking the terminus of the slots, is preferably about 30°. While the overall diameter of the heat shield 50 will vary with the size of the lamp, for use in a typical BT56 envelope, the heat shield will have a diameter of about 49 to 50 mm. The thickness of the shield 50 is preferably about 0.20 mm.

To assemble the heat shield 50, it is, of course, first necessary to manufacture the flare 16. The heat shield 50 is then set over the lead-ins by employing the receiving apertures and positioned adjacent the upper surface 52 of flare 16. When the proper orientation is achieved the disc 60 is rotated so that the slots 66 and 68 frictionally engage the lead-ins 26 and 56. Subsequently, the arc tube 12 and its frame assembly can be attached to one of the lead-ins to form the mount.

There is thus provided by this invention a new and novel heat shield which provides the desired function at a reduced cost and without introducing additional shield holding or mounting components.

While there have been shown and described what are at present considered the preferred embodiments of the invention, it will be apparent to those skilled in the art that various changes and modifications can be made herein without departing from the scope of the invention as defined by the appended claims.

What is claimed is:

1. A method of making a mount for a high intensity discharge lamp comprising the steps of: forming a glass flare having two electrically conductive, spaced-apart lead-ins each having a given diameter, projecting therefrom; forming a mica heat shield for protecting said flare, said mica heat shield comprising a planar mica disc having a pair of lead-in receiving apertures therein, said apertures having a diameter greater than said given diameter and said apertures each having an oppositely extending radial slot extending therefrom, said slots having a width less than said given diameter; fitting said lead-ins thru said lead-in receiving apertures until said mica reaches a position adjacent a surface of said flare; rotating said mica so that said oppositely extending slots frictionally engage said lead-ins and firmly position said mica; and subsequently attaching a discharge tube to said lead-ins to form said mount.

2. A mica heat shield for a high intensity discharge lamp comprising: a planar mica disc for frictionally engaging a pair of lamp lead-ins, said lamp lead-ins having a given diameter, said mica disc having a pair of lead-in receiving apertures therein, said receiving apertures having a diameter greater than said given diameter and each having an oppositely extending, radial slot extending therefrom, each of said slots having a width less than said given diameter.

3. A high intensity discharge lamp comprising: a light transmissive envelope; an arc tube located within said envelope, said arc tube containing an arc generating and sustaining medium therein; electrodes within said arc tube; a flare sealed to said lamp envelope, said flare including two electrically conductive lead-ins sealed therein, each of said lead-ins having a given diameter; and a mica heat shield comprising a planar mica disc for frictionally engaging said lead-ins, said mica disc having a pair of lead-in receiving apertures therein, said receiving apertures having a diameter greater than said given diameter and each having an oppositely extending, radial slot extending therefrom, each of said slots having a width less than said given diameter, said mica heat shield being positioned on said lead-ins closely adjacent the upper surface of said flare and having said slots in frictional engagement with said lead-ins.

* * * * *